United States Patent [19]

Ladewig et al.

[11] Patent Number: 4,710,256

[45] Date of Patent: Dec. 1, 1987

[54] APPARATUS FOR ATTACHING FLAP-OVER COVERS TO STACKS OF PAPER SHEETS OR THE LIKE

[75] Inventors: Dieter Ladewig, Jesteburg; Bernd Ramcke, Hamburg, both of Fed. Rep. of Germany

[73] Assignee: E.C.H. Will (GmbH & Co.), Hamburg, Fed. Rep. of Germany

[21] Appl. No.: 774,933

[22] Filed: Sep. 11, 1985

Related U.S. Application Data

[62] Division of Ser. No. 613,898, May 24, 1984, abandoned.

[30] Foreign Application Priority Data

Jun. 8, 1983 [DE] Fed. Rep. of Germany ..... 3320645

[51] Int. Cl.[4] ..... B42C 9/00; B42C 1/00; B42C 3/00; B42C 11/02

[52] U.S. Cl. ..... 156/484; 156/216; 156/223; 156/226; 156/556; 270/53; 412/21

[58] Field of Search ..... 156/216, 221–223, 156/226–227, 556, 477.1, 566, 492, 483–485; 412/19–21; 270/53

[56] References Cited

U.S. PATENT DOCUMENTS

| | | | |
|---|---|---|---|
| 2,640,208 | 6/1953 | Florez | 412/21 |
| 2,749,689 | 6/1956 | Colley | 156/442.2 |
| 2,820,230 | 1/1958 | Maloney | 156/477.1 |
| 3,201,810 | 8/1965 | Thorp | 412/21 |
| 3,799,827 | 3/1974 | Takimoto | 156/220 |
| 4,129,471 | 12/1978 | Rome | 156/211 |

*Primary Examiner*—Donald E. Czaja
*Assistant Examiner*—Merrell C. Cashion, Jr.
*Attorney, Agent, or Firm*—Peter K. Kontler

[57] ABSTRACT

Adhesive coated front edge faces of successive stacks of paper sheets are bonded to downwardly folded marginal portions of flap-over covers at an aligning station which receives stacks from a first source along a first path wherein the stacks are caused to advance at right angles to their adhesive-coated edge faces and which receives covers with adhesive-coated marginal portions from a second source. The covers move along a second path lengthwise of their marginal portions and in parallelism with the front edge faces of the stacks in the first path. Each stack which arrives at the aligning station is disposed behind the downwardly bent marginal portion of the corresponding cover and is thereupon moved with the cover through the nip of two rollers which apply external pressure to bond the marginal portion to the edge face of the corresponding stack. The thus obtained stationery products are thereupon introduced into the gap between two additional pressing members which apply pressure again to ensure reliable bonding of the marginal portion of each cover to the respective stack.

22 Claims, 2 Drawing Figures

APPARATUS FOR ATTACHING FLAP-OVER COVERS TO STACKS OF PAPER SHEETS OR THE LIKE

This application is a division, of U.S. application Ser. No. 613,898, filed May 24, 1984, now abandoned.

BACKGROUND OF THE INVENTION

The present invention relates to an apparatus for producing stationery products, such as steno pads, exercise books and the like. More particularly, the invention relates to improvements in apparatus for producing stationery products of the type wherein one edge face of a stack of overlapping paper sheets or the like is bonded to one marginal portion of a so-called flap-over cover sheet.

In heretofore known apparatus for the making of such stationery products, the stacks of sheets and the flap-over cover sheets are transported in the same direction through and beyond a plurality of stations. Such stations accommodate means for maintaining a stack of cover sheet blanks, means for singularizing the cover sheet blanks, means for coating one marginal portion of each cover sheet blank with adhesive at one side of the respective sheet, trimming and cutting means for the cover sheet blanks subsequent or prior to the application of adhesive, as well as means for folding over the marginal portions of the thus obtained cover sheets so as to facilitate their application to the edge faces of the corresponding paper sheet stacks.

The assembly of stationery products which flap-over cover sheets in such apparatus presents problems because the cover sheets are unlikely to be in exact register with the corresponding stacks at the time of attachment of their marginal portions to the corresponding edge faces. This affects the appearance and the quality of the ultimate products and leads to a high percentage of rejects. Moreover, the bond between the marginal portion of a flap-over cover sheet and the selected edge face of the corresponding stack of paper sheets is not reliable if the alignment of the marginal portion with the edge face is not perfect. The making of such products normally takes place in a production line wherein the stacks and the cover sheets are transported along a straight path at right angles to the selected edge faces of the stacks. Such apparatus occupy much room which is not always available in a paper processing plant.

OBJECTS AND SUMMARY OF THE INVENTION

An object of the invention is to provide a novel and improved apparatus for bonding adhesive-coated marginal portions of flap-over cover sheets to selected edge faces of stacks of paper sheets or the like in such a way that the orientation of each cover sheet with reference to the sheets of the corresponding stack is more predictable and more satisfactory than in accordance with heretofore known methods.

Another object of the invention is to provide an apparatus which ensures predictable and reliable bonding of the marginal portions of flap-over cover sheets to the selected edge faces of stacks of paper sheets or the like.

A further object of the invention is to construct and assemble the apparatus in such a way that it occupies less room, particularly as considered in the direction of travel of stacks of paper sheets or the like toward the assembling station, than a conventional apparatus.

A further object of the invention is to provide an apparatus wherein the orientation of flap-over cover sheets immediately prior to attachment to the edge faces of the corresponding stacks of paper sheets or the like is more satisfactory and more predictable than in conventional apparatus.

Still another object of the invention is to provide an apparatus of the above outlined character wherein the bonding of cover sheets to the stacks of paper sheets takes place in a small area and in a novel and improved way so as to ensure predictable bonding of selected edge faces of stacks to the adhesive-coated marginal portions of the corresponding flap-over cover sheets.

An additional object of the invention is to provide the apparatus with novel and improved means for transporting stacks of paper sheets and discrete flap-over cover sheets to the station where such cover sheets are properly aligned with the corresponding stacks.

The invention resides in the provision of an apparatus for applying flap-over cover sheets, each of which has an elongated adhesive-coated partially bent over marginal portion, to selected elongated edge faces of a series of stacks of paper sheets or the like. The apparatus comprises a source of stacks, first transporting means for advancing the series of stacks from the source along a first path and in a first direction in such orientation that the selected edge faces of the stacks in the first path extend transversely of the first direction, a source of cover sheets, second transporting means for advancing successive cover sheets from the respective source along a second path and in a second direction in parallelism with the edge faces of stacks in the first path and longitudinally of the marginal portions of the respective sheets to positions in which the marginal portion of each successive cover sheet is adjacent to the selected edge face of the corresponding stack in the first path, and pressure applying means for bonding the marginal portions of successive cover sheets to the edge faces of the respective stacks.

The apparatus preferably further comprises a first support which is disposed at a first level and serves to receive successive stacks from the first transporting means, and a second support which is disposed at a different second level and serves to receive successive cover sheets from the second transporting means. The marginal portion of the cover sheet on the second support is adjacent to the selected edge face of the stack on the first support. The two supports can constitute first and second platforms of a twin table. If the marginal portions of the flap-over cover sheets are bent downwardly, the support for the cover sheets is disposed at a level above the support for the stacks.

The pressure applying means can include a pair of rotary members defining a nip for the passage of stacks and corresponding cover sheets therethrough. The apparatus then preferably further comprises means for moving successive stacks and the corresponding cover sheets through the nip of the rotary members in the first direction. Such moving means can comprise at least one pusher which is movable into and from the first path.

The second transporting means can comprise an endless belt conveyor having an upper reach which serves to advance cover sheets in the second direction. Such second transporting means or the aforementioned pusher or pushers preferably further comprises means for locating successive cover sheets in a predetermined orientation relative to the corresponding stacks in the first path. To this end, the endless belt conveyor can cooperate with a rotary element which is disposed above the upper reach of the endless belt conveyor and serves to engage successive cover sheets from above. The rotary element and the belt conveyor cooperate to properly locate and orient successively delivered cover sheets relative to the corresponding stacks in the first path.

The first transporting means can comprise an endless flexible element and stack entraining means which is provided on such flexible element. For example, the flexible element can include or constitute a chain. The entraining means can comprise one or more pushers which are movable relative to the flexible element into and from the first path.

The aforementioned rotary members of the pressure applying means preferably include a lower roller and an upper roller with a horizontal nip between the two rollers. At least one of the rollers is preferably movable relative to the other roller so as to change the width of the nip. For example, the upper roller can be moved up and down away from and toward the lower roller. Furthermore, at least one of the rollers can be provided with a peripheral layer of rubber or other suitable elastomeric material.

Guide means in the form of sheet metal or plastic plates can be interposed between the rotary members of the pressure applying means and the first path to accurately guide successive stacks and the corresponding cover sheets into the nip. Such quide means can include an upper guide and a lower guide. The upper guide can be provided with a plurality of elongated elastic or rigid prongs and the upper roller is then preferably formed with circumferential grooves for such prongs.

Alternatively or in addition to the aforementioned rotary members of the pressure applying means, the pressure applying means can further include a first pressure applying member or anvil and a second pressure applying member which defines with the first pressure applying member a gap for reception of a portion of a stack and of the marginal portion of the corresponding cover sheet. At least one of such pressure applying members is preferably movable relative to the other member to thereby apply or relax the pressure upon the stack and the cover sheet between such members. The first pressure applying member is preferably stationery, heated and installed at a level below the second pressure applying member which latter is preferably movable up and down away from and toward the first pressure applying member. Such pressure applying members can be disposed downstream of the rotary pressure applying members, as considered in the direction of transport of stacks and corresponding cover sheets along the first path beyond the station where successive cover sheets are moved to optimum positions relative to the corresponding stacks.

The novel features which are considered as characteristics of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
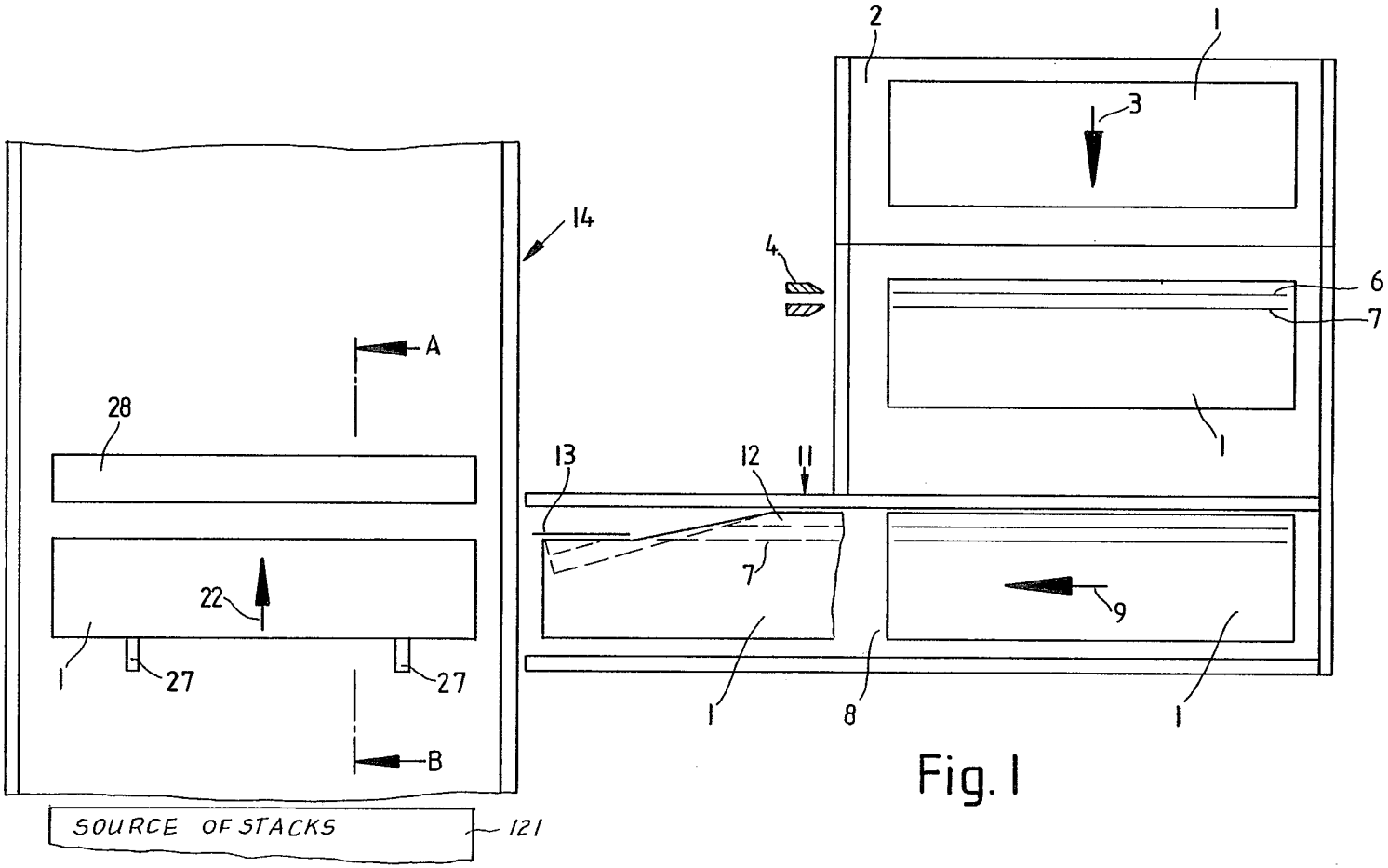
FIG. 1 is a fragmentary schematic plan view of an apparatus which embodies one form of the invention.
Figure 2:
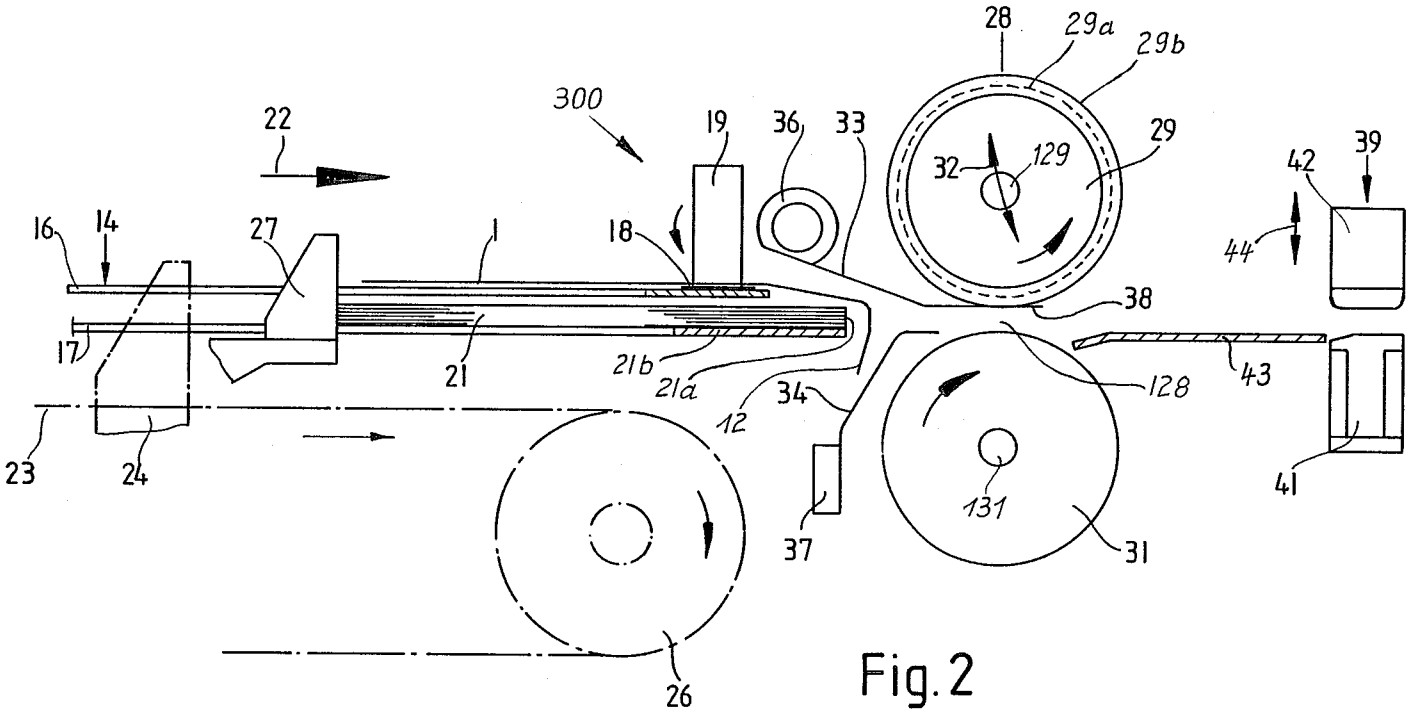
FIG. 2 is a fragmentary vertical sectional view as seen in the direction of arrows from the line A–B of FIG. 1.

Referring first to FIG. 1, there is shown a source 121 of stacks 21 (see FIG. 2) consisting of accurately overlapping paper sheets or the like. The first transporting unit of the improved apparatus comprises one or more endless chains or analogous flexible elements 23 which are trained over sprocket wheels 26 (only one shown in FIG. 2) so as to advance a succession of stacks 21 in the direction which is indicated by the arrow 22 along a horizontal path which is defined in part by the upper side of a horizontal support 17 constituting the lower platform of a twin table 14 further having a stationary second support or platform at 16 at a level above the platform 17. The space between the platforms 16 and 17 suffices for reception of a full stack 21 of the series of stacks which are being transported by the chain conveyor or conveyors 23 and by associated pushers or entraining members 24 one of which is shown by phantom lines in FIG. 2. The entraining members 24 are pivotable relative to the chain 23 so that they can descend below the path which is defined in part by the lower platform 17 of the twin table 14. FIG. 2 shows one of the entraining members 24 in raised position for the sake of illustrating its position at the time when its front edge pushes a stack 21 toward an assembling station 300.

The apparatus of FIGS. 1 and 2 further comprises a source 2 of stacked flap-over cover sheets 1 and a second transporting unit which serves to advance successive sheets 1 from the source 2 toward a second horizontal path wherein the cover sheets advance in the direction which is indicated by an arrow 9. The initial direction of transport of sheets 1 from the source 2 toward the path which is defined by a belt conveyor 18 and a roller 19 is indicated by the arrow 3. On their way from the source 2 toward the transporting unit including the belt conveyor 18 and the roller 19, successive cover sheets 1 advance through a grooving station including suitable grooving instrumentalities 4 which provide one marginal portion 12 of each cover sheet 1 with two elongated grooves 6 and 7 extending all the way between the shorter edges of the respective cover sheet. The properly grooved cover sheets 1 are thereupon transported into the range of a conveyor 8 which advances in the direction of the arrow 9 toward the second transporting unit including the belt conveyor 18 and the roller 19. While moving with the conveyor 8, the underside of the marginal portion 12 of each cover sheet 1 is coated with a suitable adhesive, preferably a hotmelt. During further transport of such cover sheets along the conveyor 8, the adhesive-coated marginal portions 12 are folded downwardly by a stationary folding member 13 so that the marginal portions 12 ultimately assume the positions which are shown in FIG. 2, namely the adhesive-coated side of each downwardly bent marginal portion 12 is located in front of an adhesive-coated front edge face 21*a* of the stack 21 at the station 300. The location of the adhesive applying device is shown in FIG. 1 at 11. The folding device 13 is designed to fold successive cover sheets 1 along the grooves 7. The distance between the grooves 6 and 7 can equal the height of a stack 21 at the station 300.

As shown in FIG. 2, the endless belt conveyor 18 and the roller 19 of the second transporting unit cooperate to advance successive sheets 1 in a direction at right angles to the plane of FIG. 2, i.e., at right angles to the direction which is indicated by the arrow 22 and in parallelism with the longitudinal extension of the front edge face 21*a* of the stack 21 at the station 300. This is in contrast to heretofore known proposals according to which cover sheets are transported in the same direction as the stacks so that the length of the apparatus for the practice of such conventional methods greatly exceeds the length of apparatus which can be utilized for the practice of the present method.

An adhesive-coated and bent cover sheet 1 can be located on the upper platform 16 of the twin table 14 while the corresponding stack 21 is in the process of arriving at the station 300. The manner in which the front edge faces 21*a* of successive stacks 21 are coated with a suitable adhesive before such stacks reach the station 300 is not specifically shown in the drawing. In fact, coating of front edge faces 21*a* with adhesive is not absolutely necessary in view of the provision of a paster (at 11) for the marginal portions 12 of the cover sheets 1. Alternatively, the applicator of adhesive for the cover sheets 1 can be omitted if the front edge faces 21*a* and the neighboring portions of the major surfaces (or of at least one of such major surfaces) of the oncoming stacks 21 are coated with adhesive.

The apparatus further comprises one or more moving means in the form of pushers 27 which are reciprocable in and counter to the direction indicated by the arrow 22 and can rise into and descend below the path for the stacks 21. The pushers 27 are lifted and caused to move in the direction of the arrow 22 when a cover sheet 1 on the upper platform 16 of the twin table 14 is to be properly oriented relative to the corresponding stack 21 on the lower platform 17. The pushers 27 thereupon introduce the stack 21 and the corresponding cover sheet 1 into the nip 128 of the upper and lower rotary members 29, 31 of a first pressure applying unit 28 which serves to ensure the establishment of a reliable bond between the marginal portion 12 of a cover sheet 1 and the front end face 21*a* of the corresponding stack 21. As mentioned above, the pushers 27 perform the additional function of properly orienting the stacks 21 and the corresponding cover sheets 1 relative to each other prior to introduction of such components into the nip 128. The forward movement of the pushers 27 is synchronized with the downward movement of the upper reach of the belt conveyor 18 and/or upward movement of the roller 19 of the second transporting unit so that such transporting unit releases the properly oriented and aligned sheet 1 before the trailing edge of such sheet is engaged by the front faces of the advancing pushers 27. The pushers 27 descend below the path of the stacks 21 as soon as the leading portion of a stack 21 and the adjacent portion of a cover sheet 1 is properly introduced into the nip 128 so that the rotating members 29, 31 can continue to advance such parts in the direction which is indicated by the arrow 22. The shaft 131 can be said to constitute one element of the means for rotating at least one of the rotary members 29, 31. The upper rotary member 29 is preferably movable along an arcuate path (see the double-headed arrow 32) toward and away from the lower rotary member 31 so as to reduce or increase the width of the nip 128. The shaft 129 can be said to constitute one element of the means for shifting or moving the upper rotary member 29 relative to the lower rotary member.

The apparatus of FIGS. 1 and 2 preferably further comprises suitable guide means for ensuring proper entry of successive stacks 21 and associated cover sheets 1 into the nip 128. Such guide means comprises a lower guide member 34 which is secured to a stationary or adjustable holder 37 in or on the frame of the apparatus, and an upper guide member 33 which is secured to a holder 36 and preferably comprises a plurality of prongs 38 which may or may not be elastic and extend into suitable circumferential grooves 29*a* machined into or otherwise formed in the periphery of the upper rotary member 29. Furthermore, at least one of the rotary members 29, 31 can be provided with a peripheral layer of elastomeric material, such as natural or synthetic rubber. FIG. 2 shows such a layer 29*b* on the upper rotary member 29. The prongs 38 of the upper guide member 33 are preferably parallel to each other and extend in parallelism with the direction which is indicated by the arrow 22. Such prongs can gently fold the major part of the oncoming cover sheet 1 over the uppermost sheet of the corresponding stack 21.

The rotary members 29 and 31 can apply sufficient pressure to ensure adequate bonding of the marginal portion 12 of the cover sheet 1 to the leading edge face 21*a* as well as to a portion of the bottom surface 21*d* of the corresponding stack 21.

The pressure applying means can further comprise a second pressure applying unit 39 which is disposed downstream of the unit 28, as considered in the direction of advancement of stacks 21 and corresponding cover sheets 1 beyond the station 300. A suitable support 43 is provided to guide successive stationery products (each of which includes a stack 21 and a cover sheet 1) toward the gap or clearance between the stationary lower pressing member 41 and the vertically reciprocable upper pressing member 42 of the second pressure applying unit 39. The lower pressing member 41 is preferably heated electrically, by a heat exchange medium or in any other suitable way. The means for reciprocating the upper pressure applying member 42 in directions indicated by the double-headed arrow 44 is not specifically shown in the drawing. Such reciprocating means can comprise a suitable eccentric or a double-acting fluid-operated motor. The purpose of the heated lower pressing member 41 is to at least partially reactivate the hotmelt which is applied to the cover sheets 1 at 11 so that the marginal portions 12 are properly bonded to the corresponding stacks 21 even if the pressure in the nip 128 does not suffice to ensure adequate bonding. The presence of the second pressure applying unit 39 is particularly important if the speed of operation of the improved apparatus is reduced so that the hotmelt which is applied at 11 has an opportunity to cool before it reaches the nip 128 between the rotary pressure applying members 29 and 31. The gap between the pressure applying members 41 and 42 preferably applies pressure to the leading portion of a stationery product at a time while such product is stationary. It is clear that the spacing between the units 28 and 39 should be sufficient to allow for introduction of the leader of a stationery product into the space between the members 41, 42 while the trailing end of such stationery product is already located downstream of the nip 128.

As a rule, each of the stacks 21 and each of the cover sheets 1 has a size several times that which is required for a finished stationery product. Therefore, the improved apparatus comprises or is followed by suitable trimming and subdividing means which converts each product advancing beyond the second pressure applying unit 39 into two or more smaller products having the required dimensions.

An important advantage of the improved apparatus is that each cover sheet 1 can be properly oriented and positioned relative to the associated stack 21 during dwell at the station 300. This is due to the provision of the transporting unit including the components 18, 19 which can advance successive sheets at right angles to the direction indicated by the arrow 22 and in optimum orientation relative to the leading edge faces 21*a* of successive stacks 21 in the first path, as well as to the provision of pushers 27 which not only move the stacks 21 and the corresponding sheets 1 into the nip 128 but can also perform a very important and desirable aligning or orienting function if such alignment and/or orientation of the stacks 21 and/or cover sheets 1 is necessary prior to bonding of the marginal portions 12 to the respective front edge faces 21*a*. FIG. 2 further shows that the positioning of a cover sheet 1 at the station 300 may be such that the adhesive-coated inner side of the marginal portion 12 is closely or immediately adjacent to the edge face 21*a* of the stack 21 on the lower platform 17 of the twin table 14.

The illustrated table 14 is designed in such a way that its upper platform 16 can support one cover sheet at a time and that its lower platform 17 can receive one stack 21 at a time.

It is also conceivable to invert the sheets 1 before they reach the station 300 or to fold the adhesive-coated marginal portions 12 upwardly if the arrangement is such that the lower platform 17 is to receive sheets 1 and the upper platform 16 is to receive stacks 21.

The second transporting unit including the belt conveyor 18 and the roller 19 can be said to constitute or resemble in its function a tongs in that the two components of this unit can be moved toward or away from each other (or at least one of these components is movable toward or away from the other component) in order to temporarily grip a cover sheet 1 during transport onto the upper platform 16 and to thereupon release such sheet so that the latter can be properly aligned or oriented and moved by the pushers 27. The means for synchronizing the movements of the pushers 24 and 27 with movements of the chain 23 and belt conveyor 18 can be of any suitable design and, therefore, such synchronizing means is not specifically shown in the drawing. It suffices to say that the movements of various parts are synchronized in such a way that the pushers 24 and 27 cannot interfere with the delivery of fresh stacks 21 and fresh cover sheets 1 to the aligning station 300 but are available for transport of stacks 21 toward such station and for transport of stacks and cover sheets from such station when the time arrives. The rotary pressure applying members 29 and 31 (or at least one of these rotary pressure applying members) can be driven continuously or intermittently.

A further important advantage of the improved apparatus is that the orientation of cover sheets 1 relative to the associated stacks 21 can be selected with a high degree of accuracy. This is attributable, in part, to the fact that the cover sheets 1 are transported at right angles to the direction of transport of stacks 21 to the station 300 as well as to the feature that the cover sheets and the stacks are preferably stationary at the time when they are aligned (if necessary) with each other by the oncoming pushers 27 prior to introduction into the nip 128 of the first pressure applying unit 28. It will be readily appreciated that accurate positioning of each cover sheet 1 relative to the associated stack 21 is much simpler and more reliable if it takes place while the components 1 and 21 are at a standstill.

An additional important advantage of the improved apparatus is that the application of external pressure takes place or can take place in several stages. This ensures proper bonding of the marginal portions 12 to the respective front edge faces 21*a* irrespective of the speed at which the apparatus is operated. All that is necessary is to heat one of the pressure applying members 41, 42 and to utilize an adhesive (such as hotmelt) which can be activated in response to the application of heat.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for applying flap-over cover sheets, each of which has an elongated downwardly extending adhesive-coated partially bent over marginal portion, to selected elongated edge faces of a series of stacks of paper sheets or the like, comprising a source of stacks; first transporting means for advancing said series of stacks from said source along a first path and in a first direction in such orientation that the selected edge faces of the stacks in said path extend transversely of said direction; a first support disposed at a first level and arranged to receive successive stacks from the first transporting means; a source of cover sheets; second transporting means for advancing successive cover sheets from the respective source along a second path and in a second direction in parallelism with the edge faces of stacks in said first path and longitudinally of the marginal portions of the respective cover sheets to positions in which the marginal portion of each successive cover sheet is adjacent to the selected edge face of the corresponding stack in said first path; a second support disposed at a second level above said first level and arranged to receive successive cover sheets from said second transporting means, the marginal portion of the cover sheet on said second support being adjacent to the selected edge face of the stack on said first support and such cover sheet being substantially parallel to the sheets of the stack on said first support; and pressure applying means for bonding the marginal portions of successive cover sheets to the edge faces of the respective stacks while the cover sheets remain substantially parallel to the sheets of the respective stacks.

2. The apparatus of claim 1, further comprising a twin table having a first platform constituting said first support and a second platform constituting said second support.

3. The apparatus of claim 1, wherein said pressure applying means includes a pair of rotary members defining a nip for the passage of stacks and corresponding cover sheets therethrough.

4. The apparatus of claim 3, further comprising means for moving successive stacks and the corresponding cover sheets through said nip in said first direction.

5. The apparatus of claim 4, wherein said moving means comprises at least one pusher, said pusher being movable into and from said first path.

6. The apparatus of claim 1, wherein said second transporting means comprises an endless belt conveyor having an upper reach arranged to advance cover sheets in said second direction.

7. The apparatus of claim 1, wherein said second transporting means further comprises means for locating successive cover sheets in a predetermined orientation relative to the corresponding stacks in said first path.

8. The apparatus of claim 1, wherein said second transporting means comprises an endless conveyor having an upper reach arranged to engage successive cover sheets from below and a rotary element disposed above said upper reach and arranged to engage successive cover sheets from above.

9. The apparatus of claim 1, wherein said first transporting means comprises an endless flexible element and stack entraining means provided on said flexible element.

10. The apparatus of claim 9, wherein said flexible element includes a chain.

11. The apparatus of claim 9, wherein said entraining means comprises a pusher which is movable relative to said flexible element into and from said first path.

12. The apparatus of claim 1, wherein said pressure applying means comprises a lower rotary member and an upper rotary member, said rotary members defining a nip for the passage of successive stacks and corresponding cover sheets therethrough.

13. The apparatus of claim 12, wherein one of said rotary members is movable relative to the other of said rotary members to thereby change the width of said nip.

14. The apparatus of claim 13, wherein said one rotary member is said upper rotary member.

15. The apparatus of claim 12, wherein at least said rotary members has a peripheral layer of elastomeric material.

16. The apparatus of claim 15, wherein said elastomeric material is rubber.

17. The apparatus of claim 12, further comprising guide means interposed between said rotary members and said first path to guide successive stacks and the corresponding cover sheets into said nip.

18. The apparatus of claim 17, wherein said guide means includes an upper guide and a lower guide, said upper guide including a plurality of elongated prongs and said upper rotary member having circumferential grooves for such prongs.

19. The apparatus of claim 1, wherein said pressure applying means includes a first pressure applying member and a second pressure applying member defining with the first pressure applying member a gap for reception of a portion of a stack and of the marginal portion of the respective cover sheet, at least one of said members being movable relative to the other of said members to thereby apply or relax the pressure upon the stack and the cover sheet therebetween.

20. The apparatus of claim 19, wherein said first pressure applying member is stationary and heated and is disposed at a level below said second pressure applying member.

21. The apparatus of claim 20, wherein said second pressure applying member is movable up and down away from and toward said first pressure applying member.

22. The apparatus of claim 19, wherein said pressure applying means further comprises two rotary pressure applying members disposed between said first path and said first and second members and defining a nip for the passage of successive stacks and corresponding cover sheets therethrough.

* * * * *